US006254405B1

(12) United States Patent
Hung

(10) Patent No.: US 6,254,405 B1
(45) Date of Patent: Jul. 3, 2001

(54) ELECTRICAL CONNECTOR

(76) Inventor: Kun-Ming Hung, 8F, No. 33, Lane 32, Jiang Nan 10th Street, Taoyuan (TW)

( * ) Notice: Subject to any disclaimer, the term of this patent is extended or adjusted under 35 U.S.C. 154(b) by 0 days.

(21) Appl. No.: 09/418,260

(22) Filed: Oct. 15, 1999

(30) Foreign Application Priority Data

Sep. 8, 1999 (TW) ..... 88215316

(51) Int. Cl.[7] ..... H01R 13/648; H01R 4/66; H01R 9/03; H01R 13/10; H01R 4/48

(52) U.S. Cl. ..... 439/101; 439/610; 439/682; 439/862

(58) Field of Search ..... 439/101, 92, 607, 439/677, 168, 608, 609, 610, 95, 682, 862, 188, 109

(56) References Cited

U.S. PATENT DOCUMENTS 3,518,610 * 6/1970 Goodman et al. ..... 339/17
3,656,183 * 4/1972 Walterscheid ..... 439/73
4,710,133 * 12/1987 Lindeman ..... 439/92
6,024,587 * 2/2000 Garth ..... 439/101
6,042,398 * 3/2000 Wu et al. ..... 439/101
6,068,514 * 5/2000 Zuin ..... 439/630

* cited by examiner

*Primary Examiner*—Paula Bradley
*Assistant Examiner*—Edwin A. León
(74) *Attorney, Agent, or Firm*—Dougherty & Troxell

(57) ABSTRACT

An electric connector, which includes a housing having two longitudinal rows of terminal slots and a longitudinal insertion slot between the longitudinal rows of terminal slots, signal terminals and grounding terminals respectively mounted in the terminal slots, and a metal grounding plate inserted into the longitudinal insertion slot, the metal grounding plate having springy protruding portions inserted into grounding terminal slots for holding down grounding terminals of the matched electric connector with respective spring strips at the grounding terminals.

1 Claim, 14 Drawing Sheets

ELECTRICAL CONNECTOR

BACKGROUND OF THE INVENTION

The present invention relates to an electric connector, more particularly to such an electric connector, which is designed for connection to a bus line to receive a matching electric connector for signal transmission.

FIG. 1 shows an electric connector according to the prior art. This structure of electric connector comprises an electrically insulative housing 10, two longitudinal rows of signal terminals 11 and a longitudinal row of grounding terminals 12 respectively mounted in the housing 10. The forked tips 13 and 14 of the terminals 11 and 12 protrude over the topside wall of the housing 10. As illustrated in FIGS. 2 and 3, the grounding terminals 12 are formed integral with one another, and elongated projecting portions 15 are provided at the metal bar of grounding terminals 12 for contacting particular terminals 11. When grounding terminals 16 of the matching electric connector are respectively inserted into the housing 10, they are respectively forced into contact with the curved bottom contact portion 17 of each of the terminals 11 being connected to the grounding terminals 12. Because the elongated projecting portions 15 at the grounding terminals 12, the curved bottom contact portions 17 of the respective terminals 11 and the grounding terminals 16 of the matching electric connector are disposed at different elevations, the grounding contact is unstable, and the unstable grounding contact tends to affect the transmission of signal.

SUMMARY OF THE INVENTION

The present invention has been accomplished to provide an electric connector, which eliminates the aforesaid problem. According to the present invention, the electric connector comprises a housing having two longitudinal rows of terminal slots and a longitudinal insertion slot between the longitudinal rows of terminal slots, signal terminals and grounding terminals respectively mounted in the terminal slots, and a metal grounding plate inserted into the longitudinal insertion slot, the metal grounding plate having springy protruding portions inserted into grounding terminal slots for holding down grounding terminals of the matched electric connector with respective spring strips at the grounding terminals. Because the springy protruding portions of the metal grounding plate and the spring strips of the grounding terminals are disposed at same elevation, the grounding terminals of the matching electric connector can be positively held down by the grounding terminals and the metal grounding plate.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
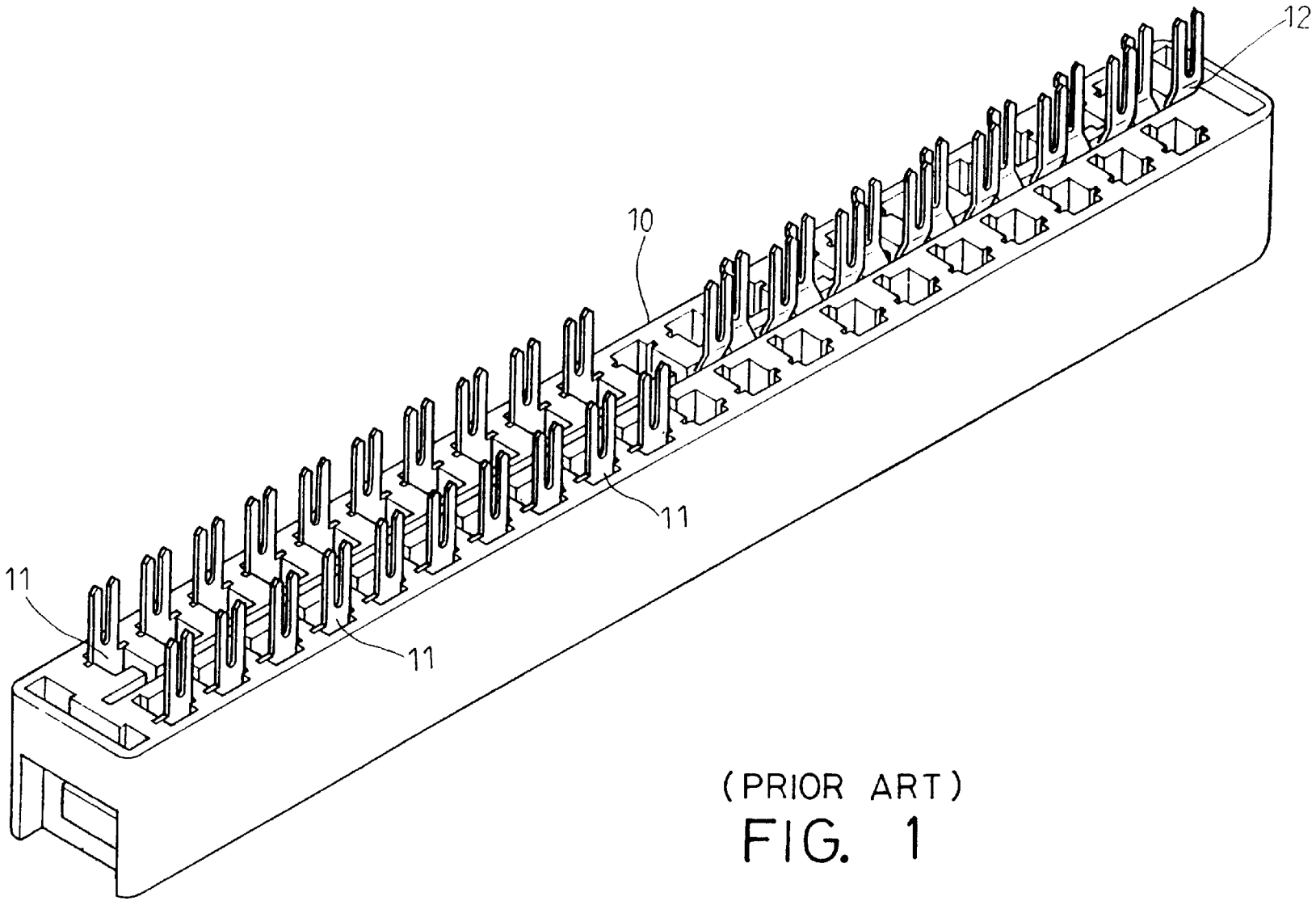
(PRIOR ART) FIG. 1
FIG. 1 is a perspective view of an electric connector according to the prior art.
Figure 2:
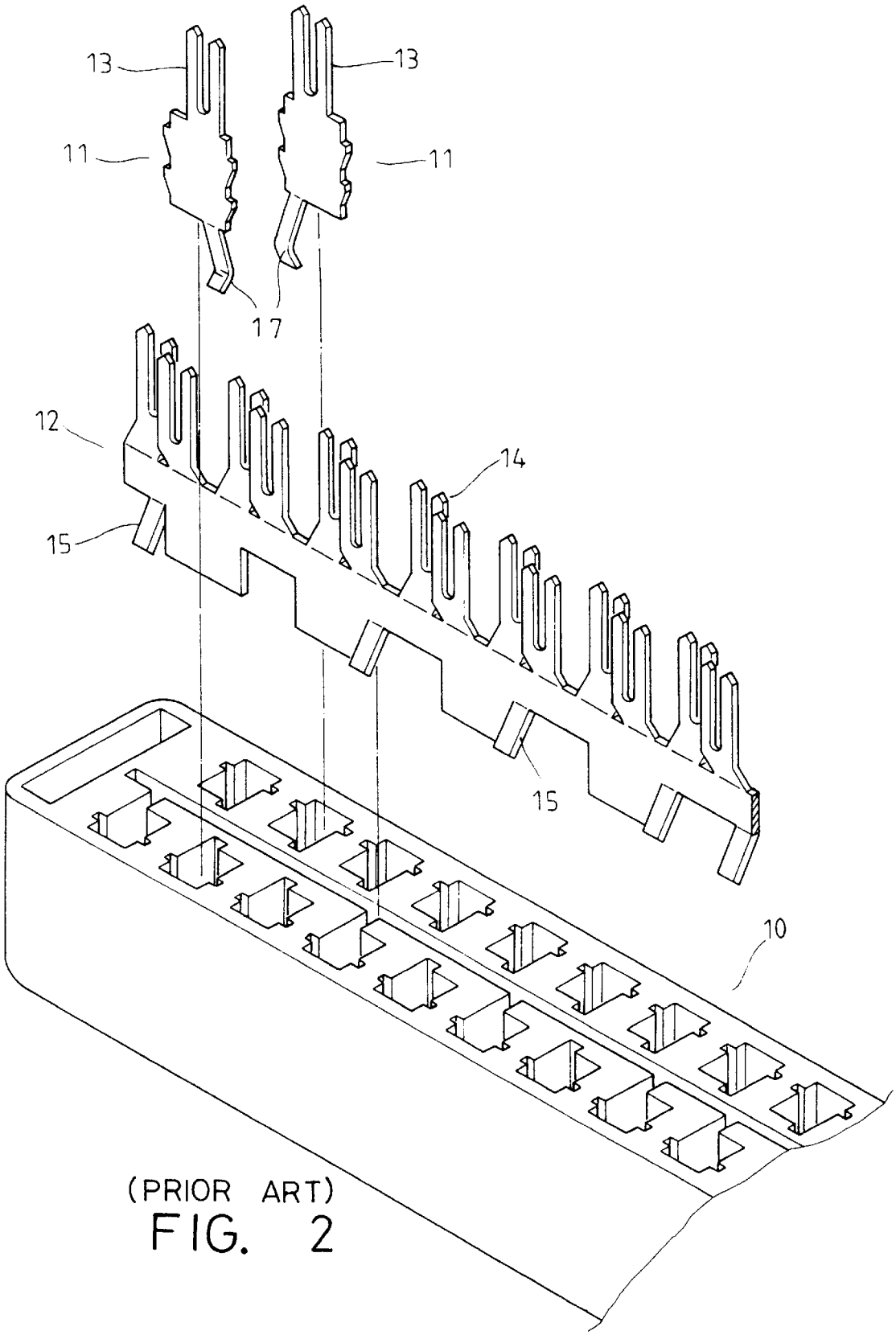
(PRIOR ART) FIG. 2
FIG. 2 is an exploded view of the electric connector shown in FIG. 1.
Figure 3:
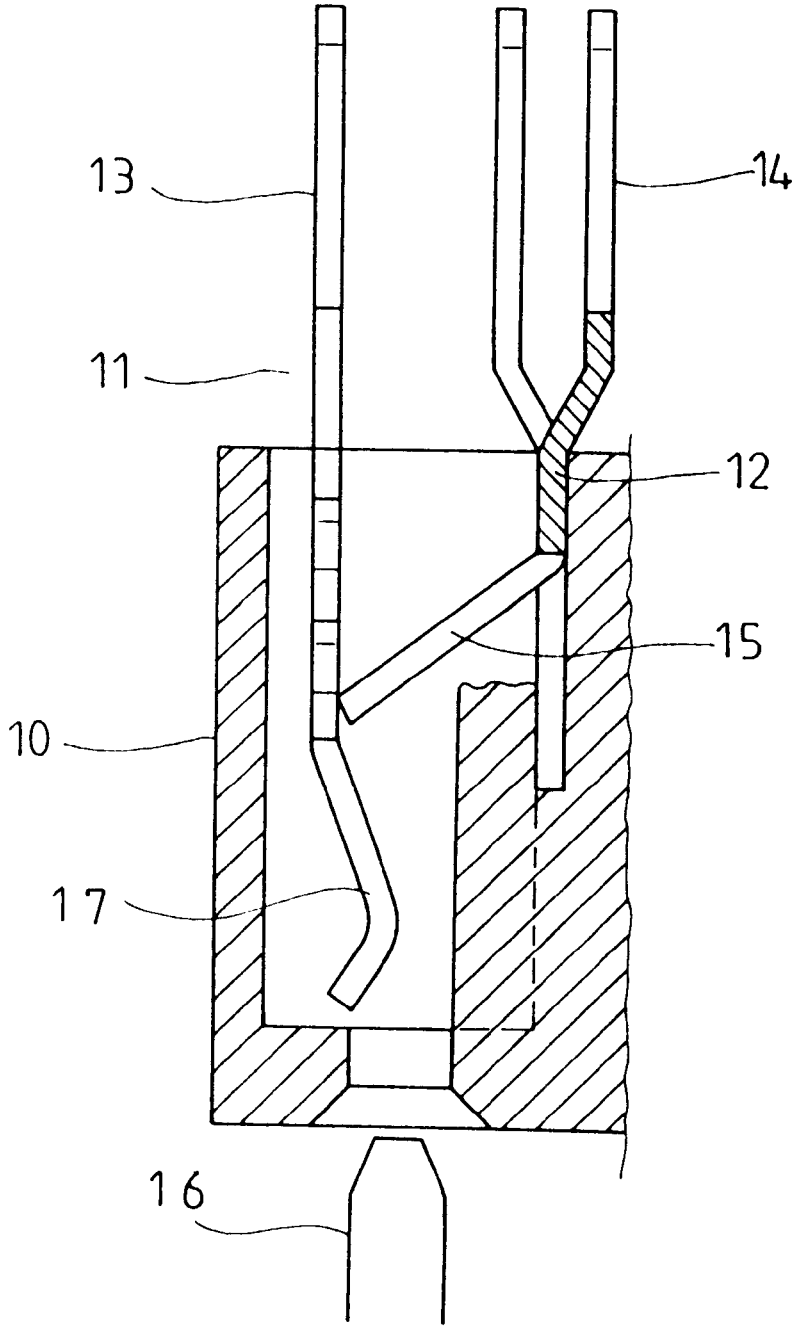
(PRIOR ART) FIG. 3
FIG. 3 is a sectional view in an enlarged scale of a part of the electric connector shown in FIG. 1, showing the terminal-grounding path.
Figure 4:
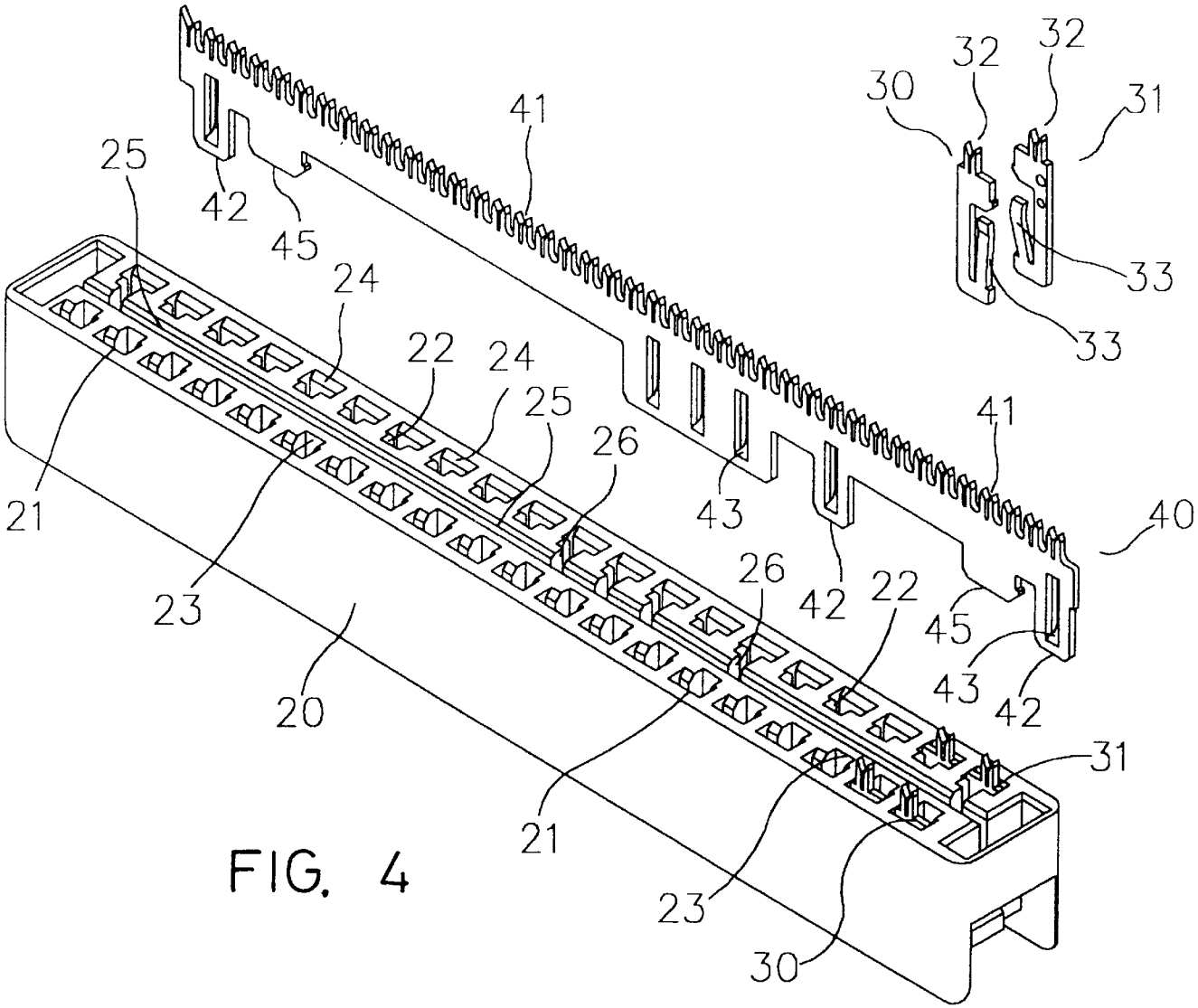
FIG. 4 is an exploded view of an electric connector according to one embodiment of the present invention.
Figure 5:
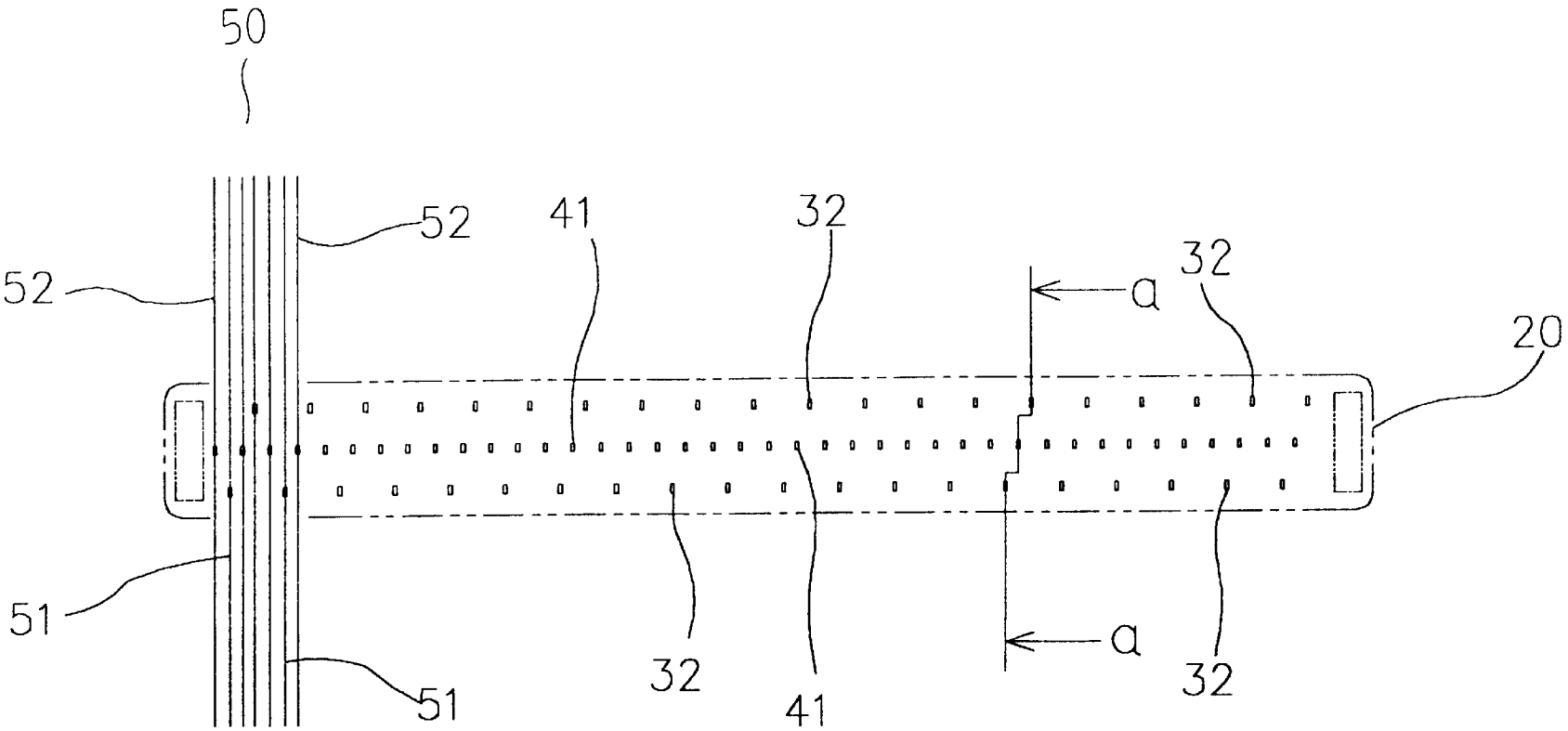
FIG. 5 is a top plan view showing a bus line connected to the electric connector according to the present invention.

Referring to FIGS. 4 and 5, an electric connector is shown comprising an elongated, substantially rectangular, electrically insulative housing 20, two rows of terminals 30 and 31, and a metal grounding plate 40. The housing 20 comprises two longitudinal rows of terminal slots 21 and 22 through top and bottom side walls thereof and arranged in parallel, two longitudinal rows of recessed receiving holes 23 and 24 respectively formed integral with the terminal slots 21 and 22 at one side, and a longitudinal insertion slot 25 longitudinally disposed on the middle between the two longitudinal rows of terminal slots 21 and 22. The terminals 30 and 31 are respectively mounted in the recessed receiving holes 23 and 24, each having an upwardly obliquely extended spring strip 33 engaged into one terminal slot 21 or 22, and an upwardly extended forked tip 32 protruding over the top side wall of the housing 20 for piercing through the insulator of a bus line 50 to make contact with one signal conductor 51 in the bus line 50. The metal grounding plate 40 comprises a plurality of downwardly extended contact portions 42 and positioning portions 45 inserted into the longitudinal insertion slot 25 at the housing 20, and a longitudinal row of forked tips 41 protruded over the top side wall of the housing 20. The forked tips 32 of the terminals 30 and 31 and the forked tips 41 of the metal grounding plate 40 are staggered.

The number of each row of terminals 30 or 31 is 20; therefore the terminals 30 and 31 totally have 40 forked tips 32. The metal grounding plate 40 has equal number of forked tips 41. At least one terminal slot 22 is provided with a notch 26 extended to the longitudinal insertion slot 25. In FIG. 4, there are 6 terminal slots 22 respectively provided with a notch 26 extended to the longitudinal insertion slot 25. The metal grounding plate 40 is made having respective protruding portions 43 engaged into the notches 26 for contact with the corresponding terminals 31.

Figure 6:
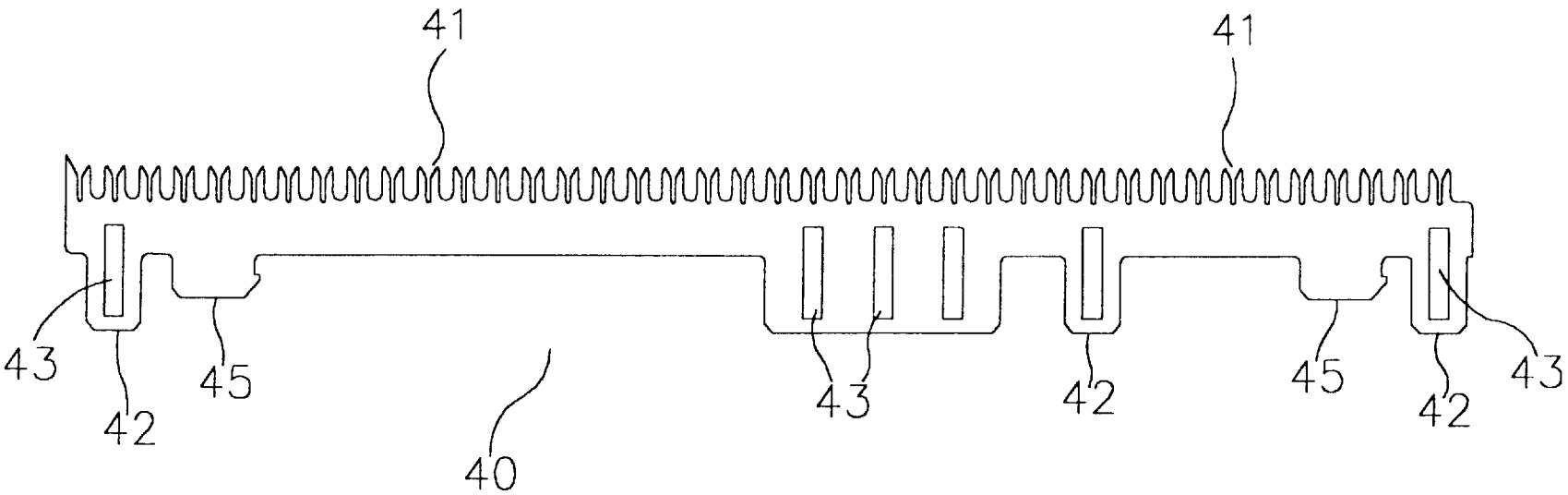
FIG. 6 is a front view of the metal grounding plate shown in FIG. 4.
Figure 7:
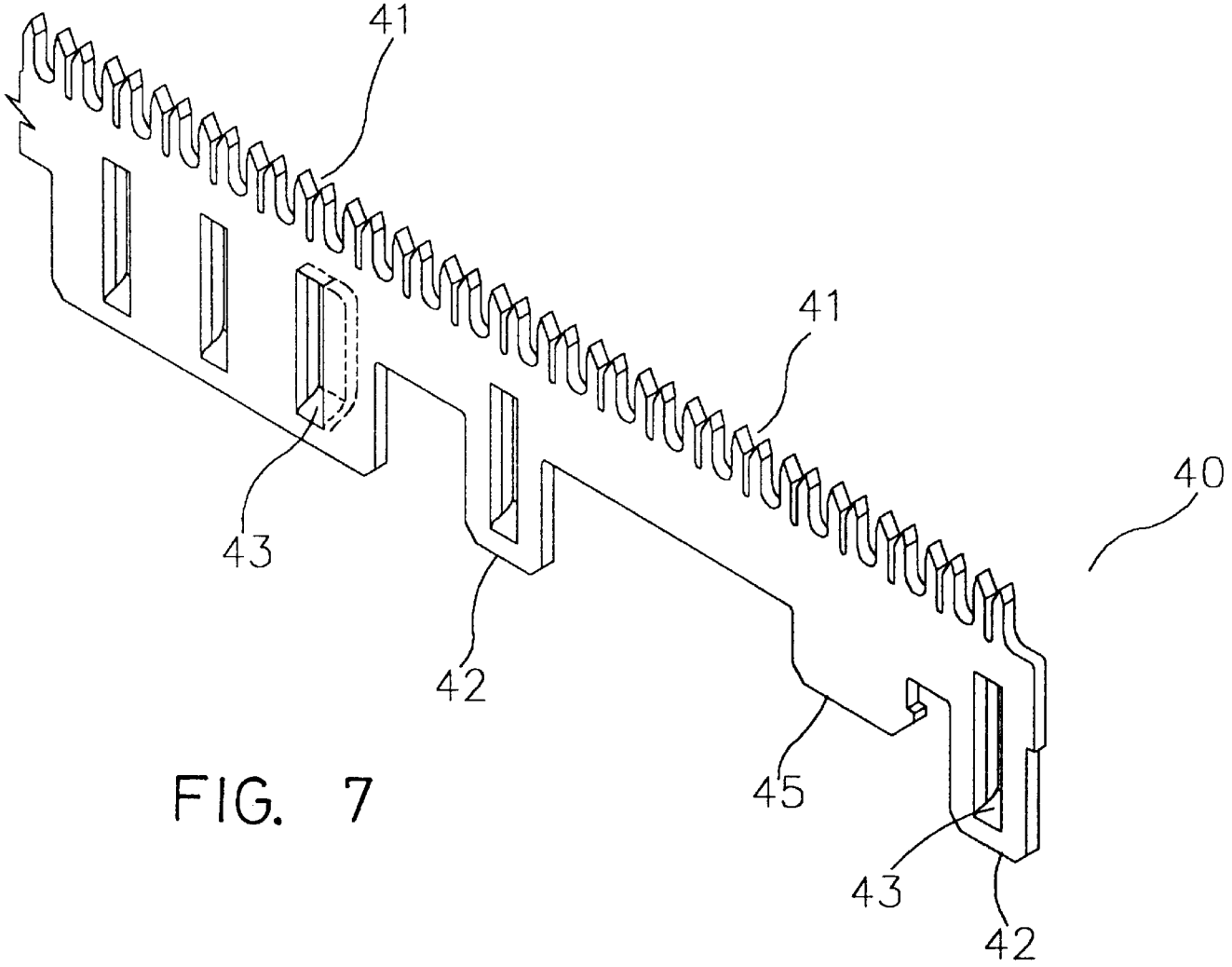
FIG. 7 is a perspective view in an enlarged scale of the metal grounding plate shown in FIG. 4.

Referring to FIGS. 6 and 7, the springy protruding portions 43 are respectively formed integral with the contact portions 42 at the metal grounding plate 40. Each springy protruding portion 43 has top and bottom ends respectively formed integral with the corresponding contact portion 42, and two opposite lateral sides separated from the corresponding contact portion 42.

Figure 8:
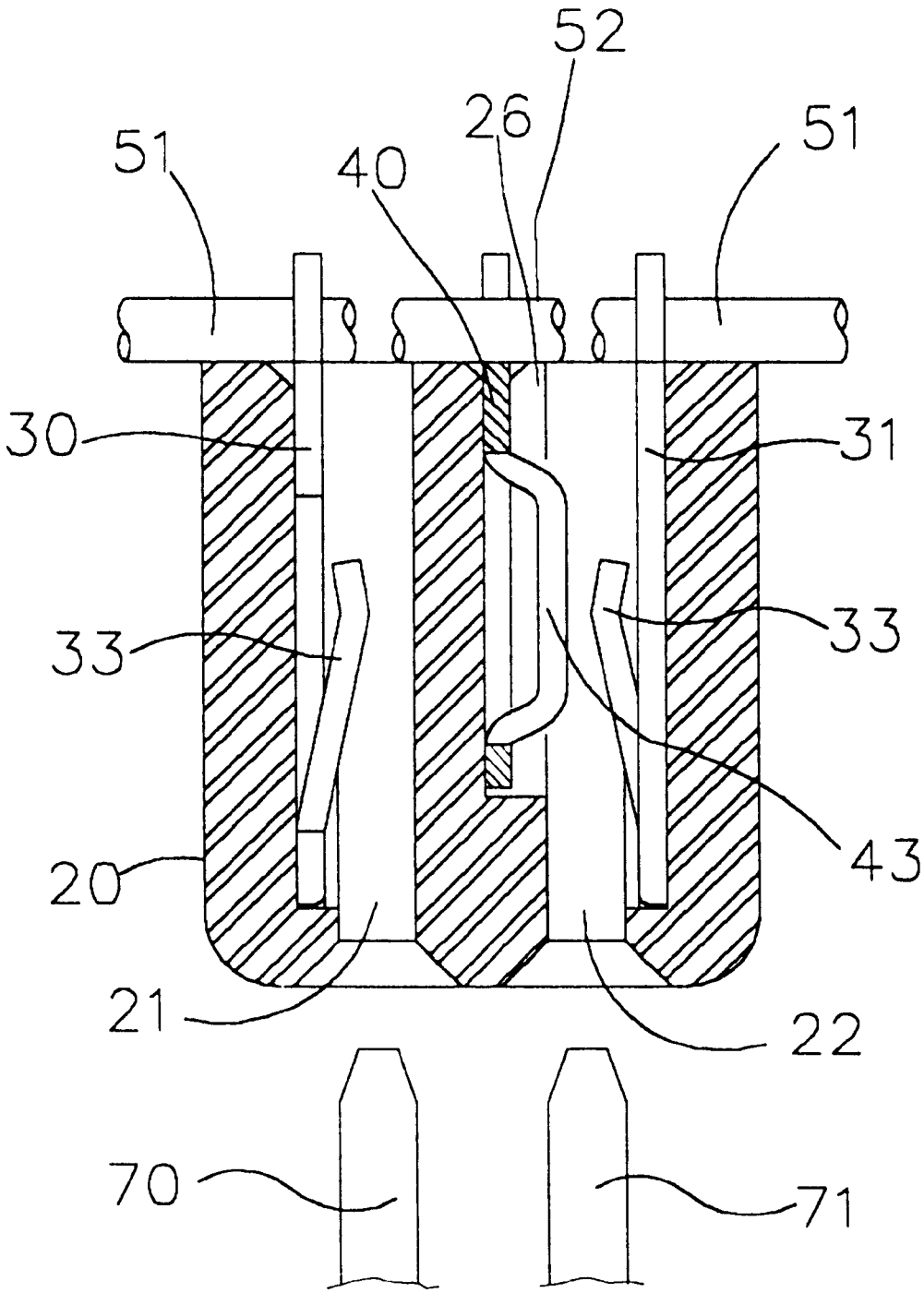
FIG. 8 is a sectional view taken along line a—a of FIG. 5.
Figure 9:
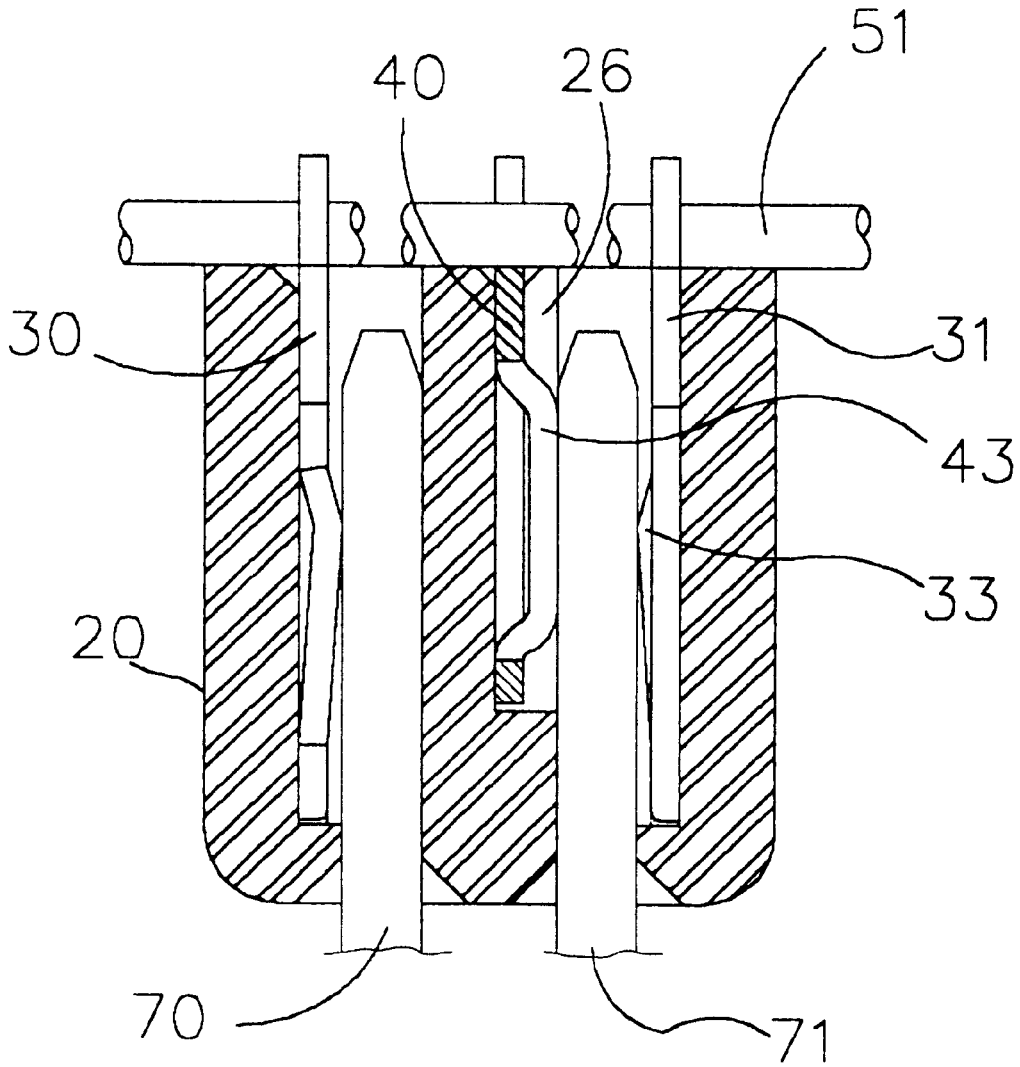
FIG. 9 is similar to FIG. 8 but showing the terminals of the matching electric connector inserted into the respective terminal slots at the housing and disposed in contact with the respective terminals and the metal grounding plate.

Referring to FIGS. 5, 8 and 9, the forked tips 32 of the terminals 30 and 31 are pierced through the insulator of the bus line 50 and make contact with a respective signal conductor 51 in the bus line 50, the springy protruding portions 43 of the metal grounding plate 40 are respectively inserted through the notches 26 into the corresponding terminal slots 22 and spaced from the spring strips 33 of the corresponding terminals 31 at a gap. When the terminals 70 and 71 of a matching electric connector are respectively inserted into the terminal slots 21 and 22 at the housing 20 from the bottom side (see FIGS. 8 and 9), the spring strips 33 of the terminals 31 and the springy protruding portions 43 are respectively stopped against the terminals 71 at two opposite sides to achieve positive grounding, and at the same time the terminals 70 are respectively disposed in contact with the terminals 30 for signal transmission.

Figure 10:
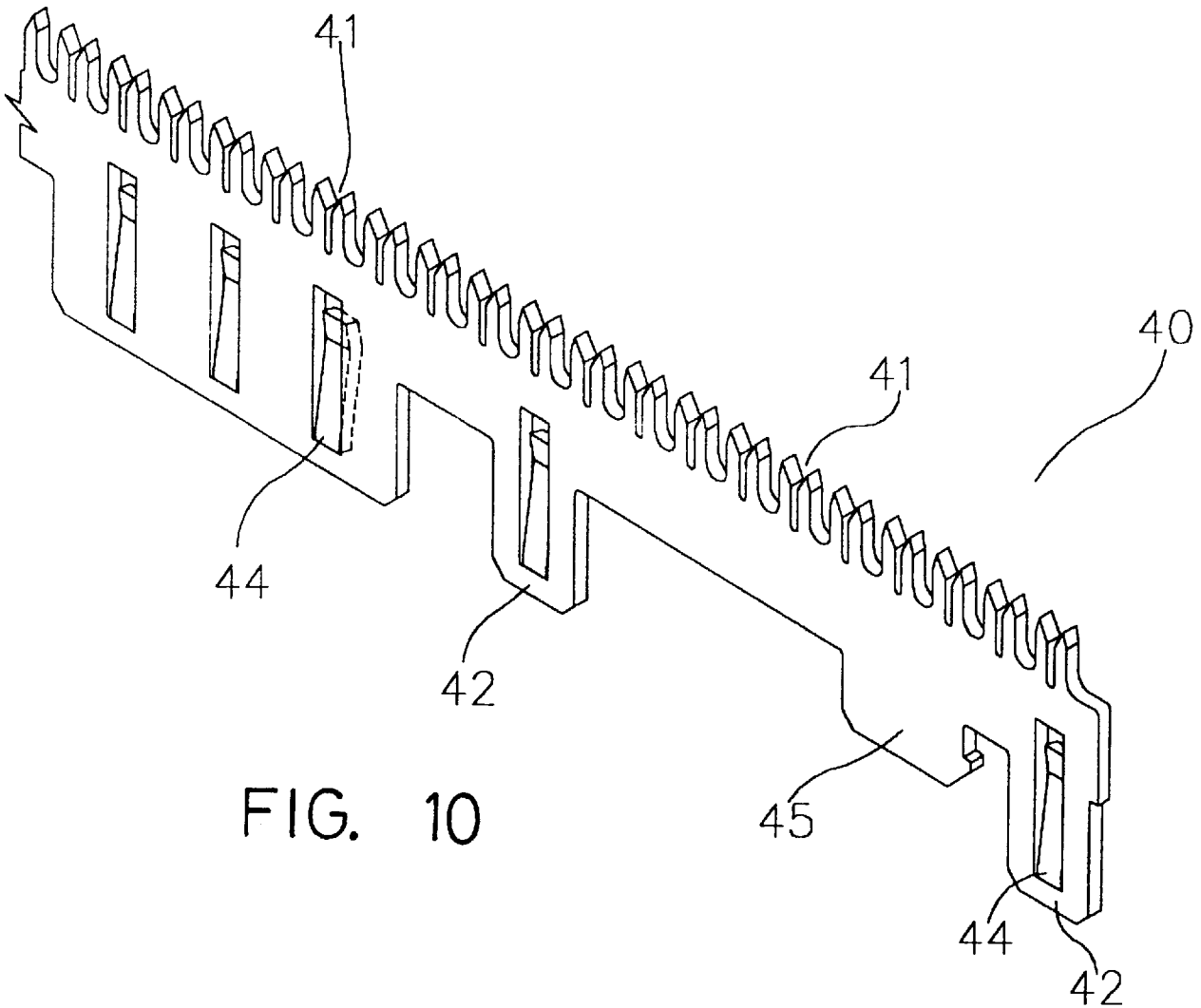
FIG. 10 is a perspective view of an alternate form of the metal grounding plate according to the present invention.

FIG. 10 shows an alternate form of the metal grounding plate 40. According to this alternate form, the springy protruding portions 44 are upwardly obliquely extended from the respective contact portions 42, i.e., each springy protruding portion 44 having a bottom end formed integral with the respective contact portion 42 and a top end suspended in the open space.

Figure 11:
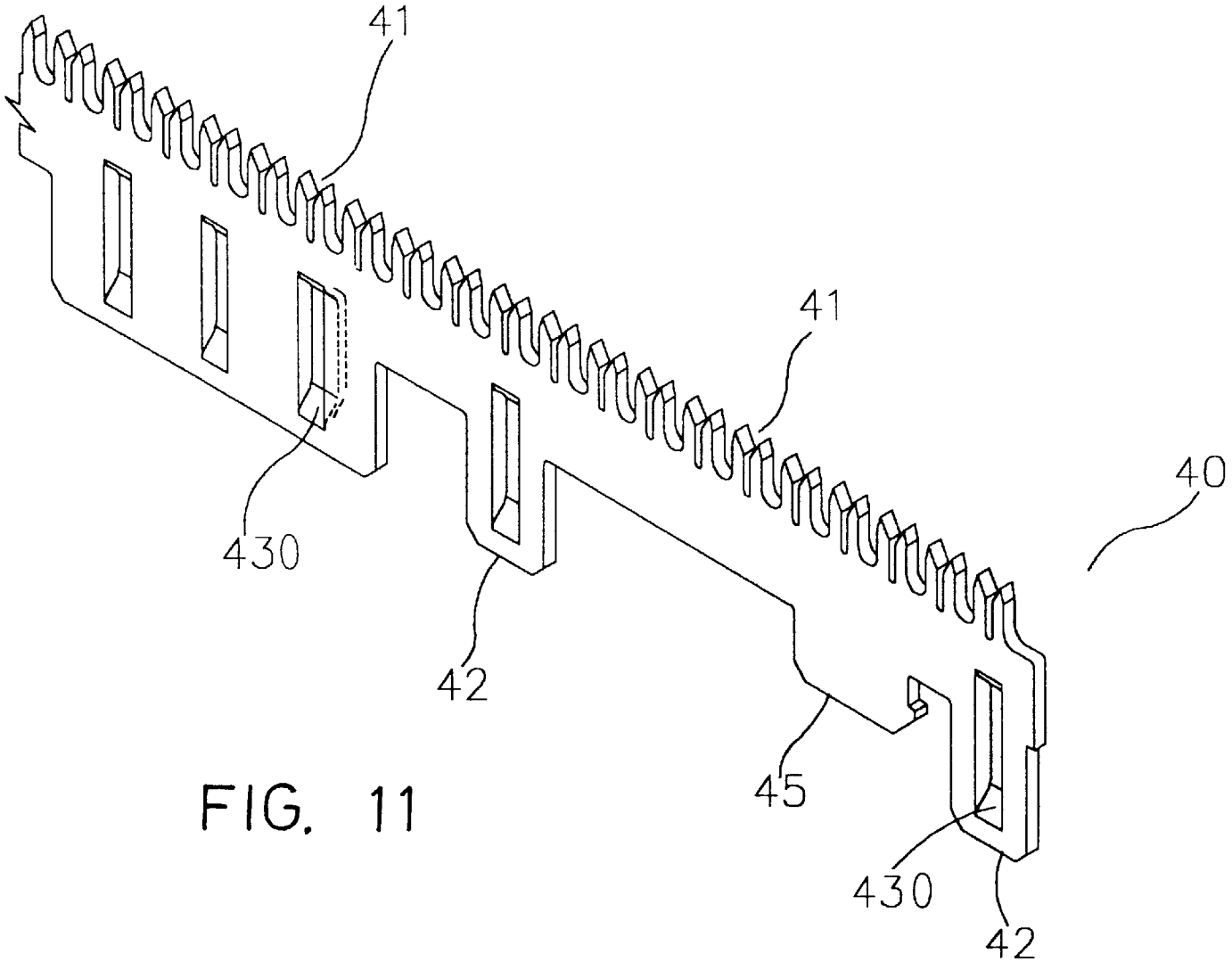
FIG. 11 is a perspective view of another alternate form of the metal grounding plate according to the present invention.

FIG. 11 shows another alternate form of the metal grounding plate 40. According to this alternate form, the springy protruding portions 430 are respectively protruded from the respective contact portions 42 at one side, and the border area of each springy protruding portion 44 is formed integral with the respective contact portion 42.

Figure 12:
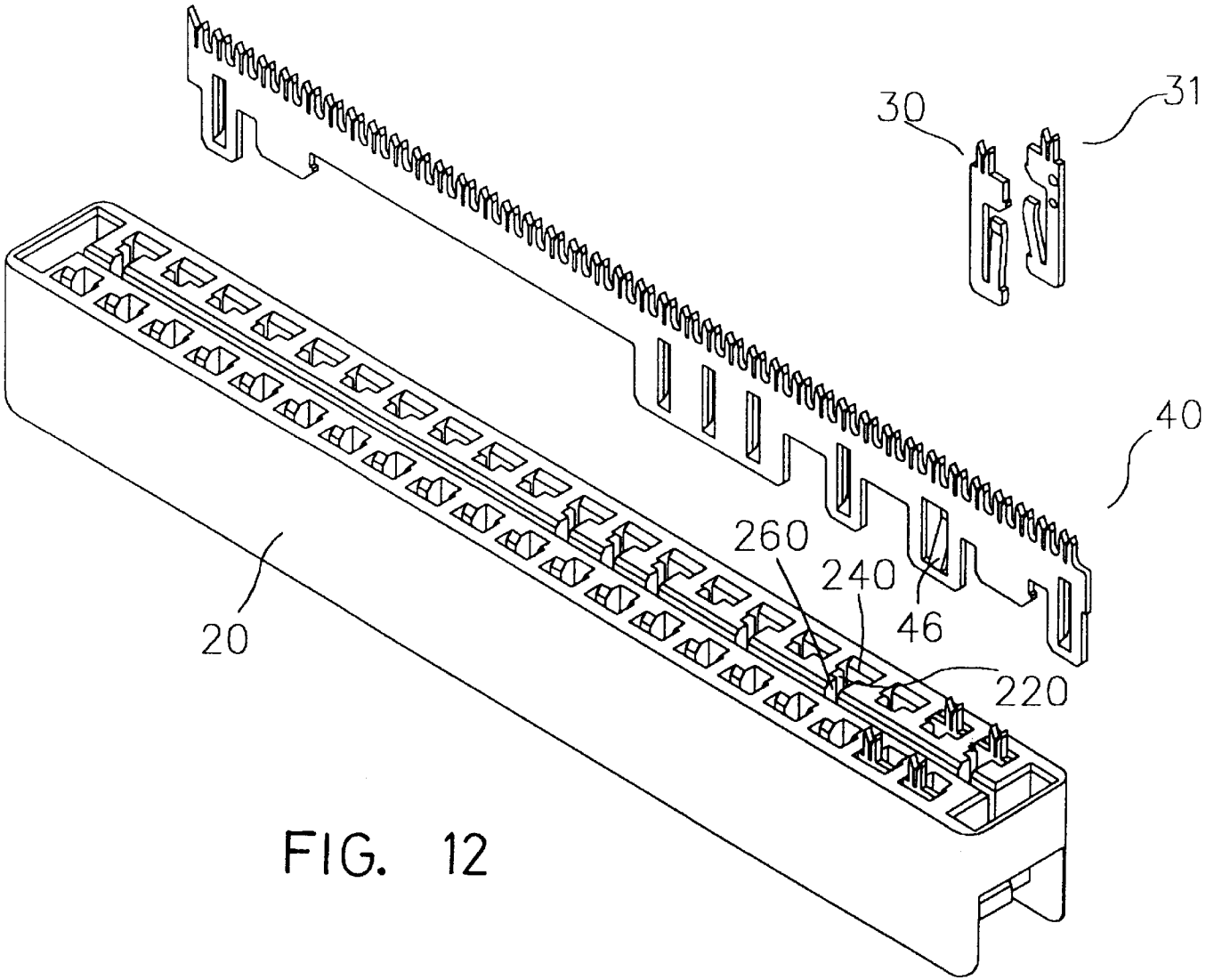
FIG. 12 is an exploded view of an alternate form of the electric connector according to the present invention.
Figure 13:
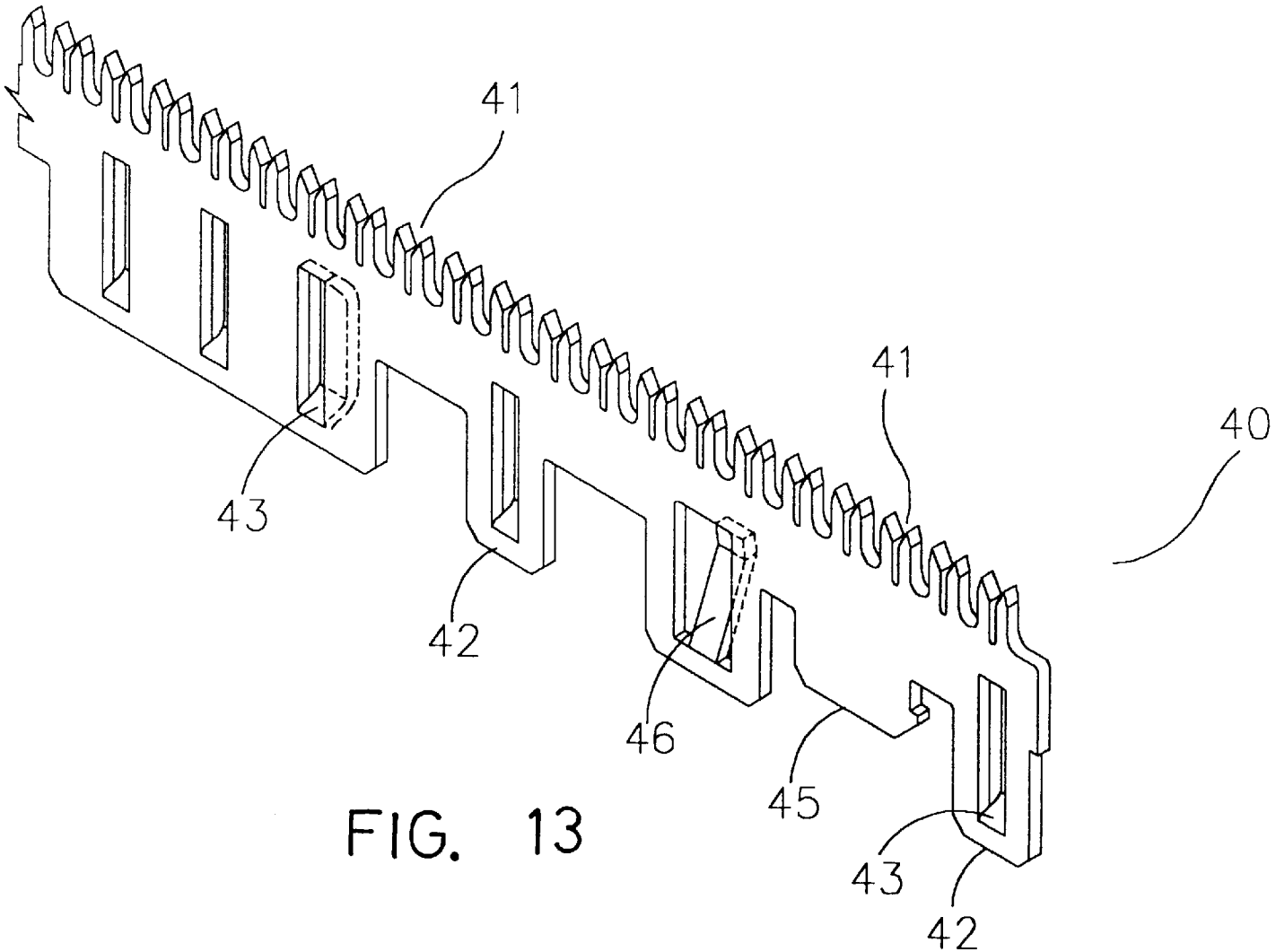
FIG. 13 is an enlarged view of FIG. 11.

FIGS. 12 and 13 show an alternate form of the present invention. According to this embodiment, a notch 260 is provided at one terminal slot 220 and the corresponding recessed receiving hole 240 does not receive a terminal. The metal grounding plate 40 comprises a spring strip 46 inserted through the notch 260 into the terminal slot 220 for contact with a grounding terminal at the matching electric connector.

Figure 14:
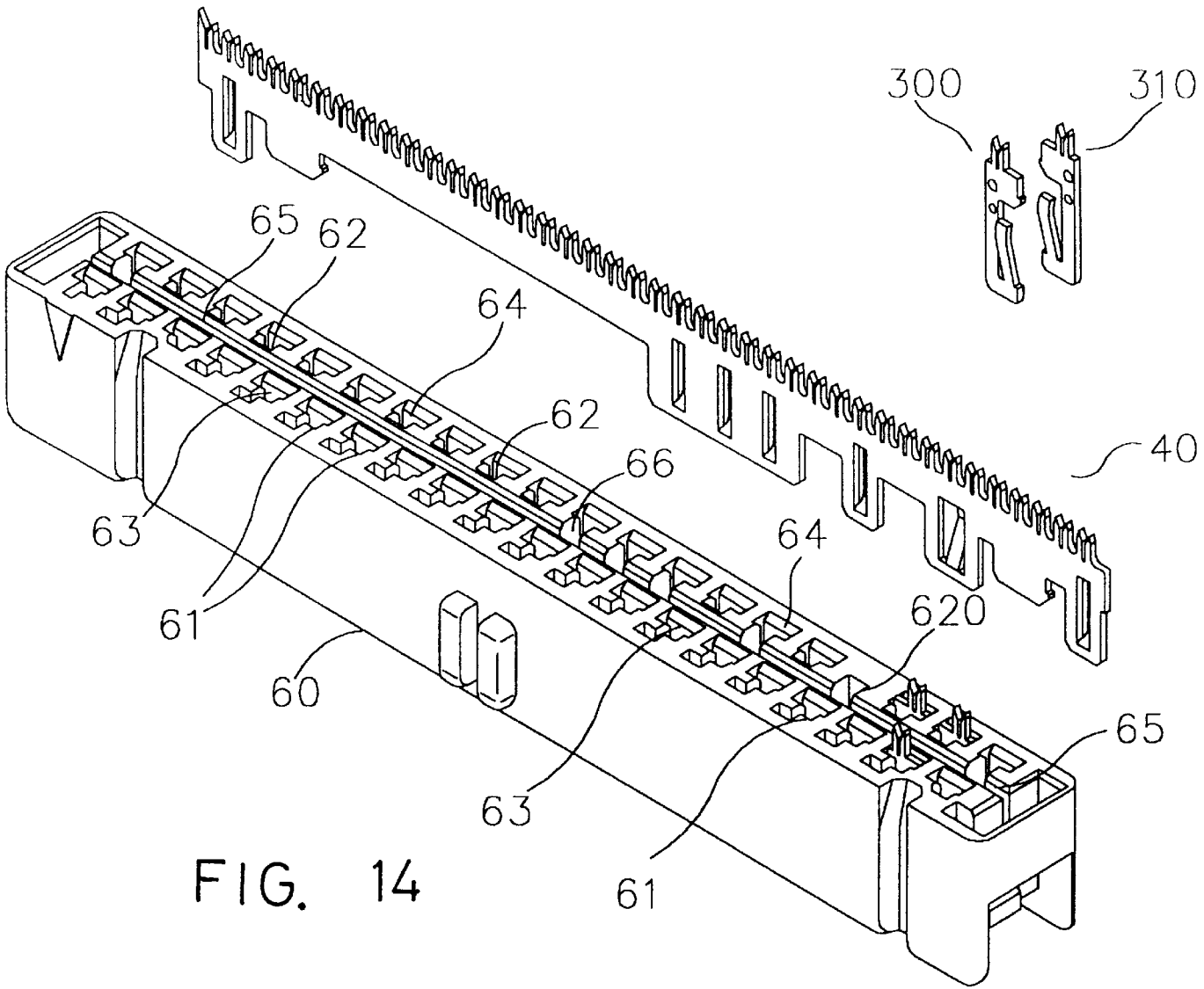
FIG. 14 is an exploded view of another alternate form of the electric connector according to the present invention.

FIG. 14 shows another alternate form of the present invention. According to this embodiment, the terminals slots 61 and 62 and recessed receiving holes 63 and 64 of the housing 60 are arranged in same direction for receiving the respective terminals 300 and 310, notches 66 are provided at the housing 60 and connected between the longitudinal insertion slot 65 and particular terminal slots 62, and one terminal slot 620 is made having no recessed receiving hole connected thereto.

It is to be understood that the drawings are designed for purposes of illustration only, and are not intended as a definition of the limits and scope of the invention disclosed.

What the invention claimed is:

1. An electric connector configured to be connected to a bus line and to a second matching electric connector for signal transmission, comprising:

an elongated, substantially rectangular, electrically insulative housing, said housing having first and second longitudinal rows of terminal slots extending through first and second opposite side walls thereof and arranged in parallel; a recessed receiving hole formed in one side of each of said terminal slots; a longitudinal insertion slot longitudinally disposed between said first and second longitudinal rows of terminal slots; and at least one notch extending between second longitudinal row of terminal slots and said longitudinal insertion slot;

a terminal respectively mounted in each of said recessed receiving holes, said terminals each having an obliquely extending spring strip extending into the associated terminal slot, and a forked tip protruding outwardly from the first side wall of said housing; and a metal grounding plate inserted into said longitudinal insertion slot, said metal grounding plate having a plurality of extending contact portions and positioning portions inserted into said longitudinal insertion slot, a longitudinal row of forked tips extending outwardly from the first side wall of said housing, and a plurality of springy protruding portions respectively formed integrally with said contact portions, each springy protruding portion extending into one of the plurality of terminal slots in said second longitudinal row, and spaced from the spring strip extending into said terminal slot so as to form a gap therebetween for receiving a connecting terminal of the second matching electric connector therebetween, wherein said plurality of springy protruding portions of said metal grounding plate each protrudes from one side of said contact portions of said metal grounding plate and wherein said plurality of springy protruding portions of said metal grounding plate each have first and second ends respectively formed integrally with the contact portion of said metal grounding plate, and two opposite lateral sides spaced from the corresponding contact portion.

* * * * *